US007511653B2

(12) United States Patent
Yu et al.

(10) Patent No.: US 7,511,653 B2
(45) Date of Patent: Mar. 31, 2009

(54) RADAR WAVE CAMOUFLAGE STRUCTURE AND METHOD FOR FABRICATING THE SAME

(75) Inventors: Fu-Sheng Yu, Dashu Shiang (TW); Wen-Lie Chang, Taipei (TW)

(73) Assignees: Chang-Sui Yu, Taipei (TW); Chun-Ying Kuo, Taipei (TW)

( * ) Notice: Subject to any disclaimer, the term of this patent is extended or adjusted under 35 U.S.C. 154(b) by 93 days.

(21) Appl. No.: 11/780,550

(22) Filed: Jul. 20, 2007

(65) Prior Publication Data

US 2009/0021415 A1 Jan. 22, 2009

(51) Int. Cl.
*H01Q 17/00* (2006.01)

(52) U.S. Cl. ..... 342/1; 342/3; 342/4

(58) Field of Classification Search ..... 342/1–4, 342/175

See application file for complete search history.

(56) References Cited

U.S. PATENT DOCUMENTS 4,728,554 A * 3/1988 Goldberg et al. ..... 428/113
4,814,546 A * 3/1989 Whitney et al. ..... 174/36
4,948,922 A * 8/1990 Varadan et al. ..... 174/353
5,106,437 A * 4/1992 Lau et al. ..... 156/51
5,110,651 A * 5/1992 Massard et al. ..... 428/105
5,325,094 A * 6/1994 Broderick et al. ..... 342/1
5,381,149 A * 1/1995 Dougherty et al. ..... 342/1
5,976,666 A * 11/1999 Narang et al. ..... 428/138
2004/0210289 A1 * 10/2004 Wang et al. ..... 607/116
2006/0007791 A1 * 1/2006 Bamdad ..... 369/13.53
2007/0243349 A1 * 10/2007 Chang ..... 428/35.7

* cited by examiner

*Primary Examiner*—John B Sotomayor
(74) *Attorney, Agent, or Firm*—Thomas, Kayden, Horstemeyer & Risley

(57) ABSTRACT

A radar wave camouflage structure is disclosed. The radar wave camouflage structure comprises a substrate; a first layer on the substrate, comprising a first polymer matrix; magnetic nanoparticles dispersed in the first polymer matrix, wherein the magnetic nanoparticles comprise a mixture of $Fe_3O_4$, $Fe_3O_4$-4C carbide, $Fe_3O_4$—Ni composite and $Fe_2O_3$; a second layer on the first layer, comprising a second polymer matrix; and carbon black dispersed in the second polymer matrix.

32 Claims, 5 Drawing Sheets

RADAR WAVE CAMOUFLAGE STRUCTURE AND METHOD FOR FABRICATING THE SAME

BACKGROUND OF THE INVENTION

1. Field of the Invention

The present invention relates to a radar wave camouflage structure and method for fabricating the same, and in particular to a radar wave camouflage structure comprising $Fe_3O_4$ nanoparticles and method for fabricating the same.

2. Description of the Related Art

Radar wave camouflage materials are widely applied in a variety of fields such as the aerospace field to absorb incident electromagnetic wave radiation without reflection. In order to avoid such wave reflection, it is necessary that the radar wave camouflage materials have a large penetration depth so that when the wave is absorbed aerospace into the material, it can be attenuated or cancelled prior to exiting the material. Additionally, absorbance of radar wave camouflage materials is associated with relative electrical conductivity ($\sigma\gamma$), relative magnetic permeability ($\mu\gamma$), thickness, dielectric constant (k) or other parameters.

BRIEF SUMMARY OF INVENTION

A radar wave camouflage structure and method for fabricating the same are provided. An exemplary embodiment of the radar wave camouflage structure comprises: a substrate; a first layer on the substrate, comprising a first polymer matrix; magnetic nanoparticles dispersed in the first polymer matrix, wherein the magnetic nanoparticles comprise a mixture of $Fe_3O_4$, $Fe_3O_4$-4C carbide, $Fe_3O_4$—Ni composite and $Fe_2O_3$; a second layer on the first layer, comprising a second polymer matrix; and carbon black dispersed in the second polymer matrix.

An exemplary embodiment of a method for fabricating a radar wave camouflage structure comprises: providing a substrate; forming a first layer on the substrate, comprising a first polymer matrix; magnetic nanoparticles dispersed in the first polymer matrix, wherein the magnetic nanoparticles comprise a mixture of $Fe_3O_4$, $Fe_3O_4$-4C carbide, $Fe_3O_4$—Ni composite and $Fe_2O_3$; forming a second layer on the first layer, comprising a second polymer matrix; and carbon black dispersed in the second polymer matrix.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF INVENTION

Figure 1:
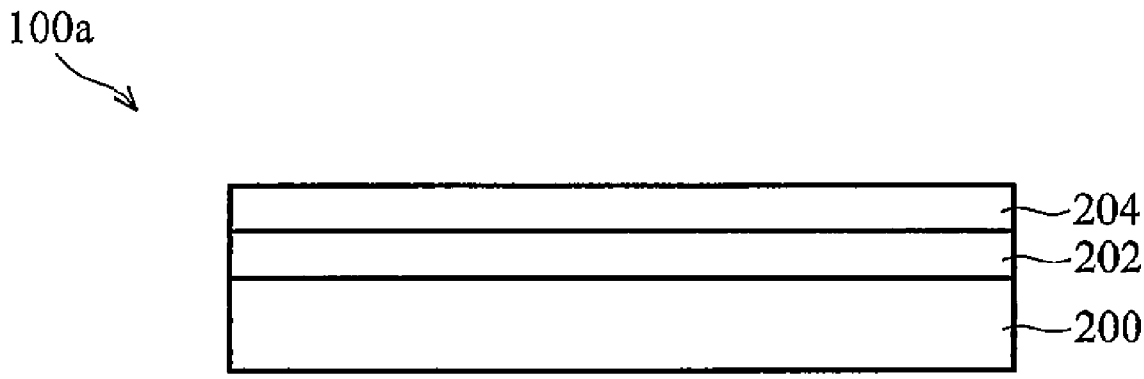
FIG. 1 shows a cross section of one exemplary embodiment of a radar wave camouflage structure.

The following description is of the best-contemplated mode of carrying out the invention. This description is made for the purpose of illustrating the general principles of the invention and should not be taken in a limiting sense. The scope of the invention is best determined by reference to the appended claims. Wherever possible, the same reference numbers are used in the drawing and the description to refer the same or like parts.

FIG. 1 shows a first exemplary embodiment of a radar wave camouflage structure 100*a*. The radar wave camouflage structure 100*a* comprises a substrate 200. A first layer 202 is formed on the substrate 200. A second layer 204 is formed on the first layer 202. The substrate 200 may comprise cloth or metal, for example, a camouflage nylon cloth or an aluminum (Al) plate. The first layer 202 may comprise a first polymer matrix and magnetic nanoparticles dispersed in the first polymer matrix. The magnetic nanoparticles may comprise a mixture of $Fe_3O_4$, $Fe_3O_4$-4C carbide, $Fe_3O_4$—Ni composite and $Fe_2O_3$. The first polymer matrix preferably comprises about 90~110 parts by weight of polyurethane (PU) resin with number average molecular weight (Mw) between 60000 and 500000 or polyether polyols with Mw between 500 and 2000. In one embodiment, polyurethane (PU) resin may comprise one-component polyurethane (PU) resin or two-component polyurethane (PU) resin. The magnetic nanoparticles preferably comprises a mixture of about 1~20 parts by weight of $Fe_3O_4$-4C carbide, about 1~10 parts by weight of $Fe_3O_4$—Ni composite, about 1~10 parts by weight of $Fe_3O_4$, 1~10 parts by weight of $Fe_2O_3$. In one embodiment, the magnetic nanoparticles preferably have an average particle size between 1 nm to 9.9 nm. Additionally, the first layer 202 may comprise about 0.5~5 parts by weight of a rubber softening oil such as (na) phthenic processing oil and about 1~10 parts by weight of $Sb_2O_3$.

The second layer 204 may comprise a second polymer matrix, preferably comprises about 90~110 parts by weight of polyurethane (PU) resin with Mw between 60000 and 500000 or polyether polyols with Mw between 500 and 2000. In one embodiment, polyurethane (PU) resin may comprise one-component polyurethane (PU) resin or two-component polyurethane (PU) resin. Additionally, the second layer 204 may comprise by mixing conductive particles such as carbon black, a filler such as zinc stearate and a matting agent such as silica. Preferably, the second layer 204 comprises about 1~15 parts by weight of carbon black, about 1~5 parts by weight of the filler and 0.01~1 parts by weight of the matting agent. Additionally, the second layer 204 may comprise about 1~10 parts by weight of a rubber softening oil such as (na) phthenic processing oil.

Figure 2:
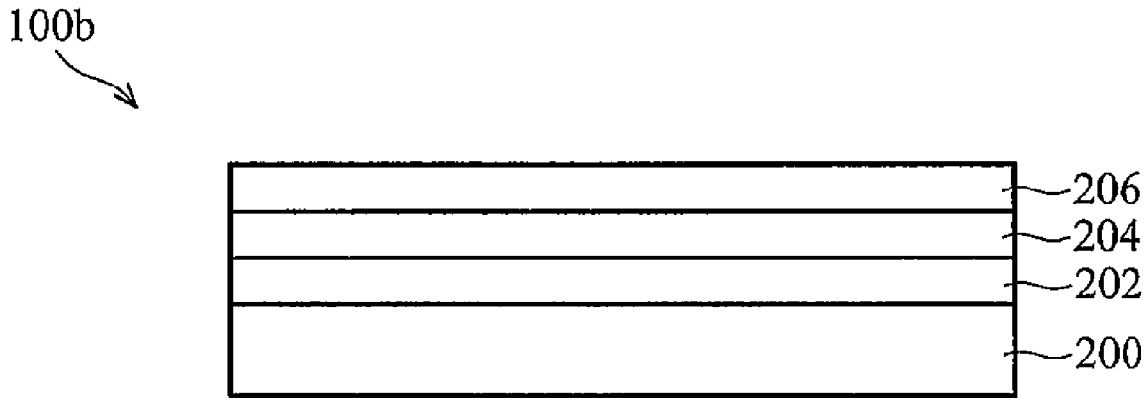
FIG. 2 shows a cross section of another exemplary embodiment of a radar wave camouflage structure.

FIG. 2 shows another exemplary embodiment of a radar wave camouflage structure 100*b*. The radar wave camouflage structure 100*b* comprises a substrate 200. A first layer 202 is formed on the substrate 200. A second layer 204 is formed on the first layer 202. A third layer 206 is formed on the second layer 204. The third layer 206 may comprise a third polymer matrix, preferably comprises about 90~110 parts by weight of polyurethane (PU) resin with Mw between 60000 and 500000 or polyether polyols with Mw between 500 and 2000. In one embodiment, polyurethane (PU) resin may comprise one-component polyurethane (PU) resin or two-component polyurethane (PU) resin. Additionally, the third layer 206 may comprise by mixing conductive particles such as carbon black, a filler such as zinc stearate, a matting agent such silica, wax, and an anti-oxidant. Preferably, the third layer 206 comprises about 1~15 parts by weight of carbon black, about 0.1~5 parts by weight of the filler, about 0.01~10 parts by weight of wax, about 0.01~10 parts by weight of the anti-oxidant and about 0.01~1 parts by weight of the matting agent. Additionally, the third layer 206 may comprise about 1~10 parts by weight of a rubber softening oil such as (na) phthenic processing oil.

The step of forming the first layer 202 further comprises mixing the magnetic nanoparticles, a rubber softening oil, a solvent comprising about 0~50 parts by weight of N-butylacetate (n-BAC), and the first polymer matrix to form a first coating material. The first coating material can be stirred for 1 to 30 minutes, preferably for 1 to 5 minutes. After stirring the first coating material, the first coating material can be left standing for 2 to 10 hrs. Next, the first coating material can be mixed by a three-roll(er) mill for more uniformity. In one embodiment, the first coating material can be mixed two times. After mixing the first coating material, a crosslinker such as polyisocyanate may be added to the first coating material. When adding the crosslinker in the first coating material, the first coating material can be stirred for 1 to 30 minutes, preferably for 1 to 5 minutes. Next, a crosslinker such as aliphatic isocyanates with a NCO content between 10% and 15% may be added to the first coating material with stirring for 1 to 30 minutes, preferably for 1 to 5 minutes. Next, the first coating material may be applied to the substrate 200 to form the first layer 202 by knife coating or roll coating. A thickness of the first layer is between about 10 and 50 μm.

Additionally, the step of forming the second layer 204 further comprises mixing carbon black, the filler, the matting agent, the rubber softening oil, and the second polymer matrix to form a second coating material. The second coating material can be stirred for 1 to 30 minutes, preferably for 1 to 5 minutes. After stirring the second coating material, the second coating material can be left standing for 2 to 10 hrs. Next, the second coating material can be mixed by a three-roll(er) mill for more uniformity. In one embodiment, the second coating material can be mixed two times. Next, a crosslinker such as aliphatic isocyanates with a NCO content between 10% and 15% may be added to the second coating material with stirring for 1 to 30 minutes, preferably for 5 to 10 minutes. Next, the second coating material may be applied to the first layer 202 to form the second layer 204 by knife coating or roll coating. A thickness of the second layer is between about 0.1 and 2 mm.

In another embodiment, the step of forming the third layer 206 further comprises mixing the second conductive particles, the filler, the matting agent, wax, an anti-oxidant, the rubber softening oil, and the third polymer matrix to form a third coating material. The third coating material can be stirred for 1 to 30 minutes, preferably for 1 to 5 minutes. After stirring the third coating material, the third coating material can be left standing for 2 to 10 hrs. Next, the third coating material can be mixed by a three-roll(er) mill for more uniformity. In one embodiment, the third coating material can be mixed two times. Next, a crosslinker such as aliphatic isocyanates with a NCO content between 10% and 15% may be added to the third coating material with stirring for 1 to 30 minutes, preferably for 5 to 10 minutes. Next, the third coating material may be applied to the second layer 204 to form the third layer 206 by knife coating or roll coating. A thickness of the third layer is between about 0.1 and 1 mm.

In one embodiment of the radar wave camouflage structure, the magnetic nanoparticles comprising $Fe_3O_4$ can absorb electromagnetic waves transforming into heat. When magnetic materials, for example, $Fe_3O_4$, are stimulated by the magnetic field of electromagnetic waves, magnetic dipole moments inside the magnetic materials are aligned and oriented along the direction of the magnetic field. When the magnetic field direction of electromagnetic wave converts along with frequency, the magnetic field changes immediately. Hysteresis phenomenon thus occurs to consume the energy of electromagnetic wave due to coercivity force of the magnetic material.

EXAMPLES

Example 1

About 10 g of $Fe_3O_4$-4C carbide (manufactured by SongSing Nano Co.), about 3.5 g of $Fe_3O_4$—Ni composite (manufactured by SongSing Nano Co.), about 1.7 g of $Fe_3O_4$ (manufactured by SongSing Nano Co.), about 4.8 g of $Fe_2O_3$ (manufactured by, for example, Zolax Co.), about 2 g of $Sb_2O_3$ (manufactured by Go Yen Co.), 1 g of (na) phthenic processing oil (manufactured by Sheng Huei Co.) and about 25 g of N-butylacetate (n-BAC) were mixed in about 100 g of polyurethane (PU) resin (U176 manufactured by Toong Goen Co.) to form a first coating material. Next, the first coating material was stirred for 5 minutes. After stirring the first coating material, the first coating material was left standing for 2 hrs. Next, the first coating material was mixed by a three-roll(er) mill two times. After mixing the first coating material, a crosslinker, polyisocyanate with a NCO content between 13% and 13.3% (BD 176 manufactured by, Toong Goen Co.), was added in the first coating material. When adding the modifier to the first coating material, the first coating material was stirred for 5 minutes. Additionally, about 10 g of carbon black (CB-EC manufactured by SongSing Nano Co.), about 2 g of zinc stearate (manufactured by Sheng Huei Co.), about 4 g of (na) phthenic processing oil, about 30 g of N-butylacetate (n-BAC) (manufactured by Ginmin Co.) and 0.05 g of silicon dioxide (OK412 manufactured by Degussa Co.) were mixed in about 100 g of polyurethane (PU) resin (UR176 manufactured by Toong Goen Co.) to form a second coating material. The second coating material was stirred for 5 minutes. After stirring the second coating material, the second coating material was left standing for 2 hrs. Next, the second coating material was mixed by a three-roll(er) mill two times. Next, the first coating material was applied to a camouflage nylon cloth to form the first layer 202 having a thickness of about 20 μm. The second coating material was then applied to the first layer 202 to form the second layer 204 having a thickness of about 120 μm, thus completing the radar wave camouflage structure of Example 1.

Example 2

About 10 g of $Fe_3O_4$-4C carbide composite (manufactured by SongSing Nano Co.), about 4 g of $Fe_3O_4$—Ni composite (manufactured by SongSing Nano Co.), about 2 g of $Fe_3O_4$ (manufactured by SongSing Nano Co.), about 5 g of $Fe_2O_3$ (manufactured by Zolax Co.) and 1~2 parts by weight of (na) phthenic processing oil (manufactured by Sheng Huei Co.) were mixed in about 100 g of polyether polyols (UM176B manufactured by Toong Goen Co.) to form a first coating material. Next, the first coating material was stirred for 5 minutes. After stirring the first coating material, the first coating material was left standing for 2 hrs. Next, the first coating material was mixed by a three-roll(er) mill two times. After mixing the first coating material, the closslinker, aliphatic isocyanates (UM176A manufactured by Toong Goen Co.), was added to the first coating material with stirring for 5 minutes. Additionally, about 10 g of carbon black (CB-EC manufactured by SongSing Nano Co.), about 1.5 g of zinc stearate (manufactured by Sheng Huei Co.), about 4 g of phthenic process oil (manufactured by Sheng Huei Co.) and 0.1 g of silicon dioxide (OK412 manufactured by Degussa Co.) were mixed in about 100 g of polyurethane (PU) resin (UM176B manufactured by Toong Goen Co.) to form a second coating material. The second coating material was stirred for 5 minutes. After stirring the second coating material, the second coating material was left standing for 2 hrs. Next, the second coating material was mixed by a three-roll(er) mill two times. After mixing the second coating material, the closslinker, aliphatic isocyanates (UM176A manufactured by Toong Goen Co.), was added in the second coating material and stirred for 5 minutes. Additionally, about 5 g of carbon black (CB-EC manufactured by, for example, SongSing Nano Co.), about 1 g of zinc stearate (manufactured by Sheng Huei Co.), about 32 g of (na) phthenic processing oil (manufactured by Sheng Huei Co.), about 0.5 g of sunguard wax, about 0.5 g of 2,2'-methylene-bis-4-meyhyl-6-tert-butylphenol (AO-2246 manufactured by Sheng Huei Co.) as antioxidant and 0.05 g of silica silicon dioxide (OK412 manufactured by Degussa Co.) were mixed in about 100 g of polyurethane (PU) resin (UM176B manufactured by Toong Goen Co.) to form a third coating material. The third coating material was stirred for 5 minutes. After stirring the third coating material, the third coating material was left standing for 2 hrs. Next, the third coating material was mixed by a three-roll(er) mill two times. After mixing the third coating material, the closslinker, aliphatic isocyanates (UM176A manufactured by Toong Goen Co.), was added to the third coating material and stirred for 5 minutes. Next, the first coating material was applied to a metal plate to form the first layer 202 having a thickness of about 20 μm. The second coating material was then applied to the first layer 202 to form the second layer 204 having a thickness of about 1.6 mm. The third coating material was then applied to the second layer 204 to form the third layer 206 having a thickness of about 0.4 mm thus completing the radar wave camouflage structure of Example 2.

Radar Wave Absorbing Test

The radar wave camouflage structure of Example 1 and Example 2 were applied to a camouflage nylon cloth (30 cm×30 cm) and a aluminum plate (30 cm×30 cm) respectively to form radar wave camouflage coating samples to carry out a radar wave absorbing test using a time domain measurements system (Geozondas, Lithuania provided by Dor Chia Communication Co., Ltd). The radar wave camouflage coating samples were placed in front of the time domain measurements system with a distance of about 2.5 meter to 3 meter at room temperature throughout the 0~20 GHz frequency band including a wave camouflage frequency band between 8~12 GHz. Generally speaking, the testing results showed good radar wave absorbing performance while an absorbance of the radar wave camouflage structure was greater than 10 dB in the 8~12 GHz frequency band.

Figure 3:
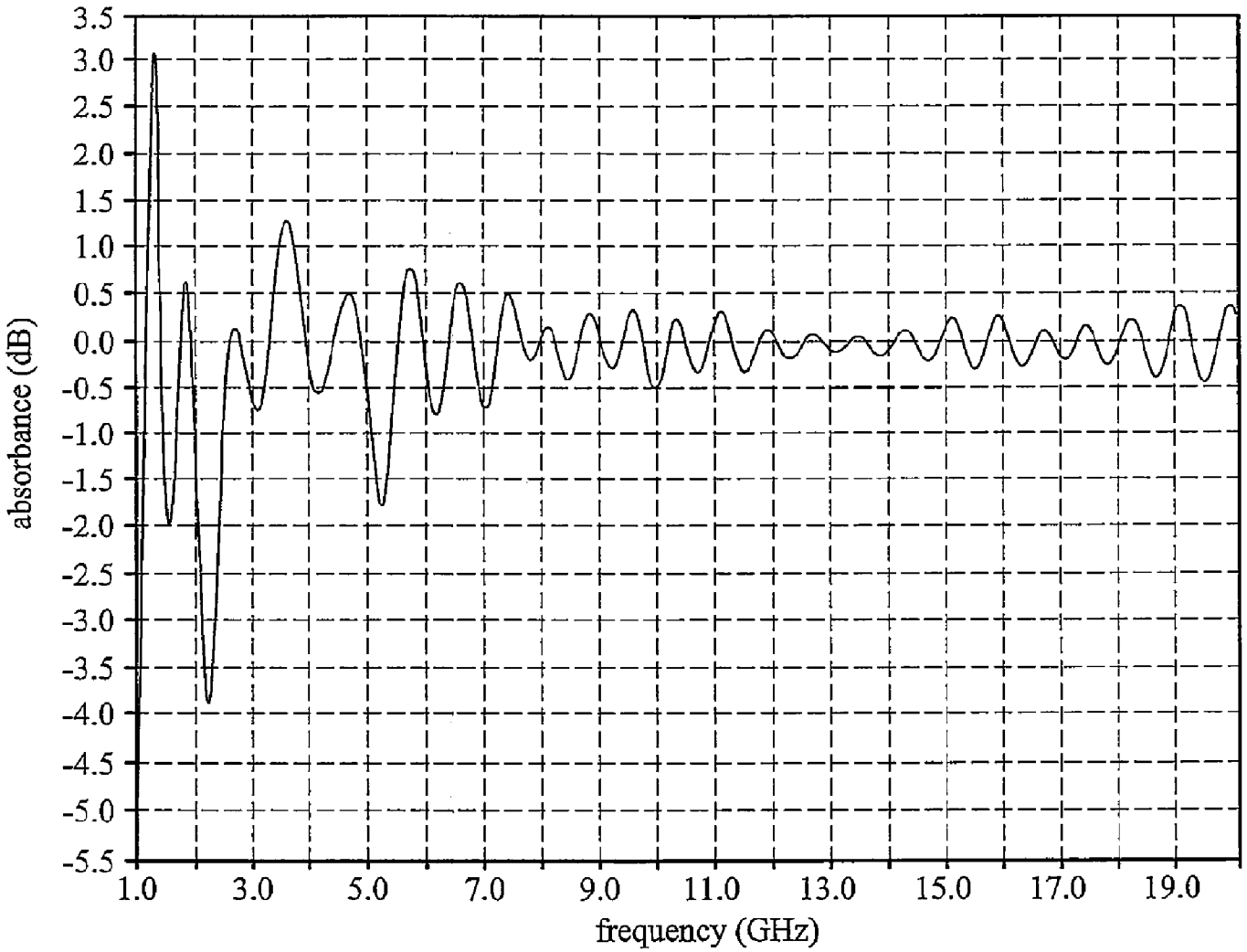
FIG. 3 shows a radar wave absorbing result in dB of only a camouflage nylon cloth.

The testing results are shown in FIGS. 3 to 6. FIG. 3 shows a radar wave absorbing result in dB of only the camouflage nylon cloth. The absorbance of the camouflage nylon cloth was about 0 dB in the 8~12 GHz frequency band. The test result showed that radar wave was not absorbed by the camouflage nylon cloth.

Figure 4:
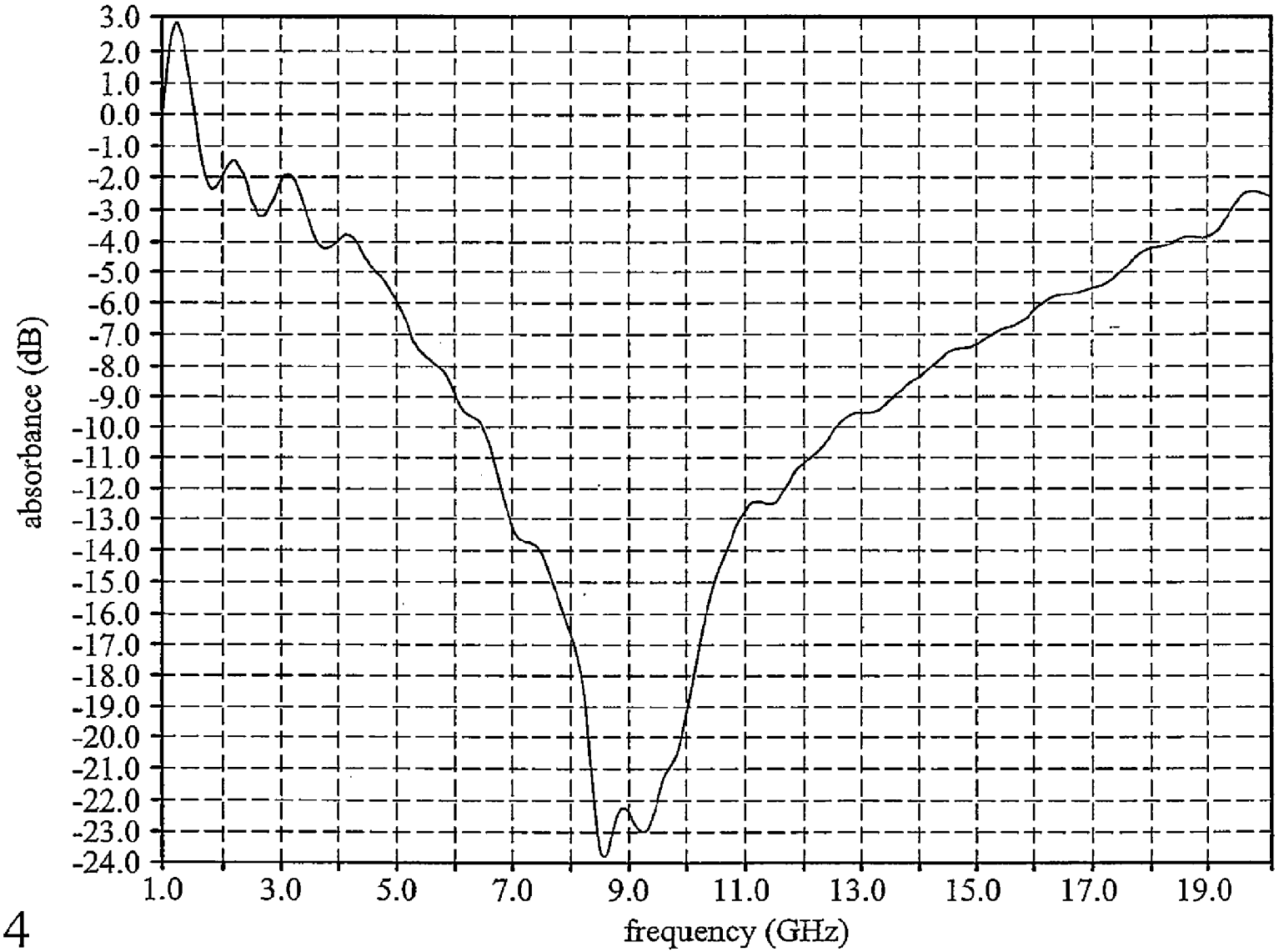
FIG. 4 shows a radar wave absorbing result in dB of Example 1 applied to a camouflage nylon cloth.

FIG. 4 shows a radar wave absorbing result in dB of Example 1 applied to the camouflage nylon cloth (30 cm×30 cm). The test result of Example 1 showed good radar wave camouflage performance with an absorbance of about −24 dB in the 8~12 GHz frequency band.

Figure 5:
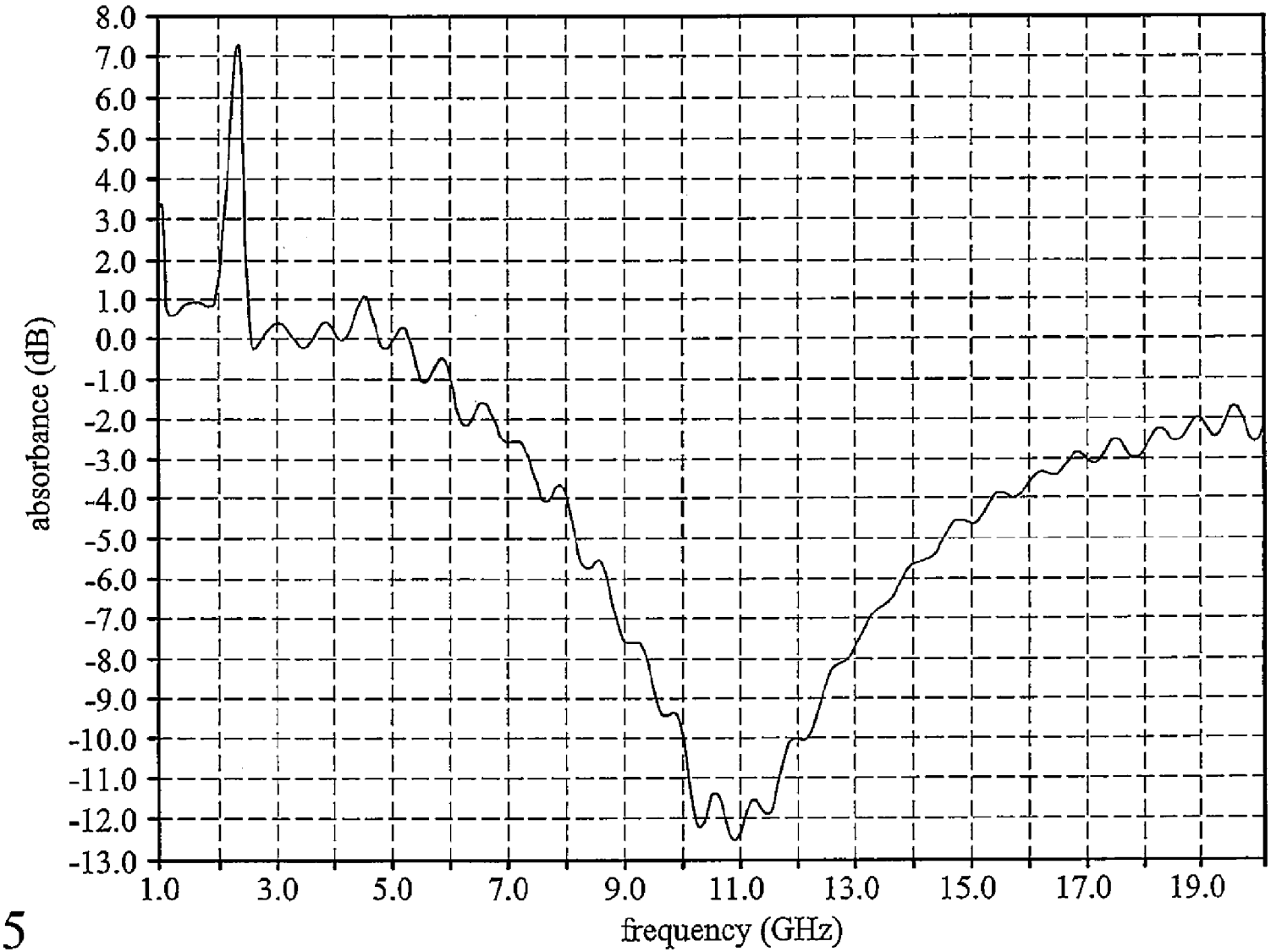
FIG. 5 shows a radar wave absorbing result in dB of Example 2 applied to an aluminum plate.

FIG. 5 shows the radar wave absorbing result in dB of Example 2 applied to the aluminum plate (30 cm×30 cm). Also, the test result of Example 2 showed good radar wave camouflage performance with an absorbance of about −12 dB in the 8~12 GHz frequency band.

Figure 6:
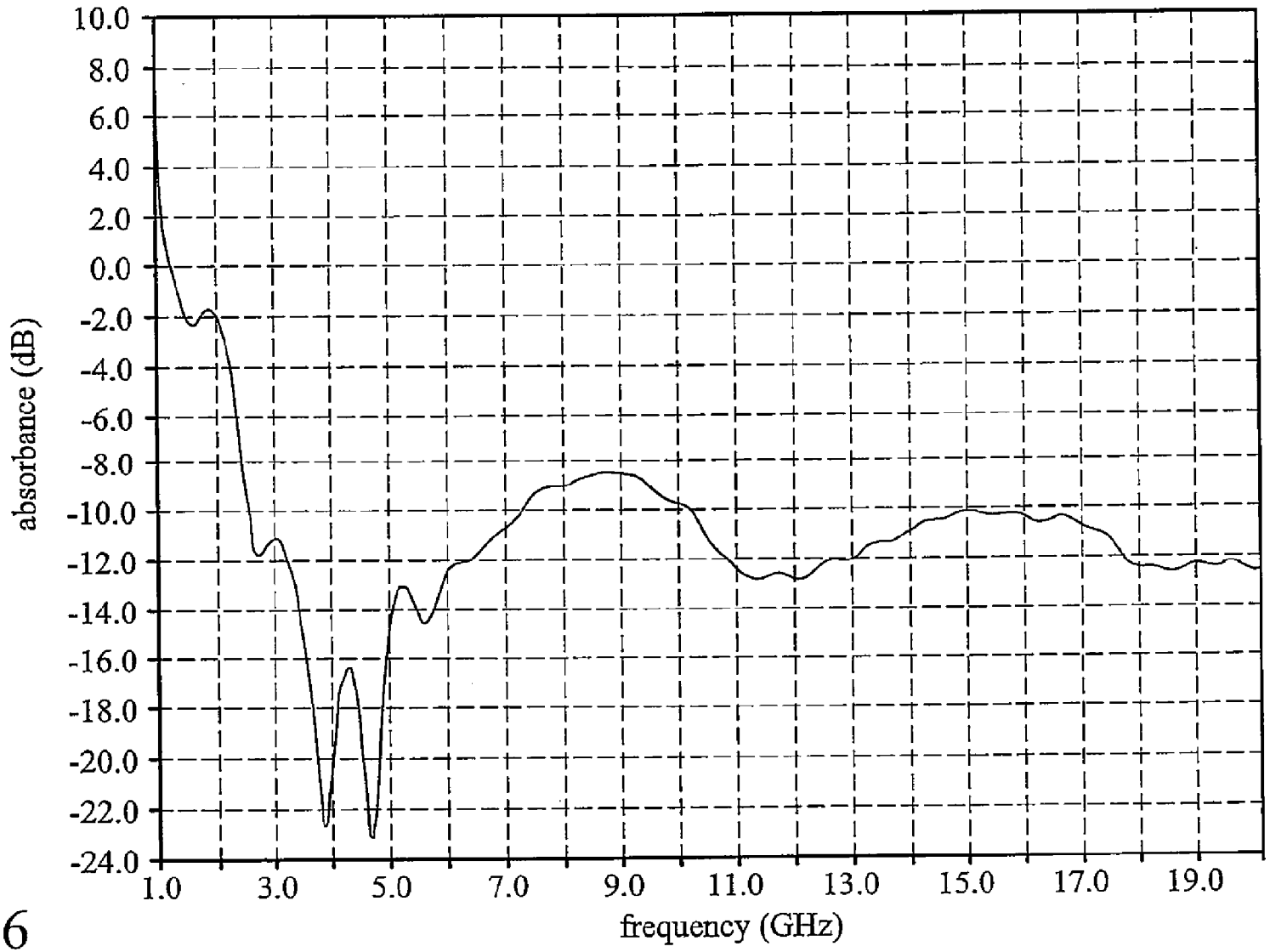
FIG. 6 shows a radar wave absorbing result in dB of Example 1 applied to a camouflage nylon net.

FIG. 6 shows the radar wave absorbing result in dB of Example 1 applied to the camouflage nylon net (30 cm×30 cm) with a thickness of about 0.12 mm. Also, the test result of Example 3 showed good radar wave camouflage performance with an absorbance of about −10 dB in the 8~12 GHz frequency band.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A radar wave camouflage structure, comprising:

a substrate;

a first layer on the substrate, comprising:

a first polymer matrix; and magnetic nanoparticles dispersed in the first polymer matrix, wherein the magnetic nanoparticles comprise a mixture of $Fe_3O_4$, $Fe_3O_4$-4C carbide, $Fe_3O_4$—Ni composite and $Fe_2O_3$; and a second layer on the first layer, comprising:

a second polymer matrix; and carbon black dispersed in the second polymer matrix.

2. The radar wave camouflage structure as claimed in claim 1, further comprising a third layer on the second layer, comprising:

a third polymer matrix; and carbon black dispersed in the third polymer matrix.

3. The radar wave camouflage structure as claimed in claim 2, wherein the first, second and third polymer matrix are polyurethane (PU) resin.

4. The radar wave camouflage structure as claimed in claim 2, wherein the third layer further comprises a filler comprising zinc stearate and a matting agent.

5. The radar wave camouflage structure as claimed in claim 2, wherein the third layer further comprises wax and a rubber softening oil.

6. The radar wave camouflage structure as claimed in claim 1, wherein the first layer further comprises $Sb_2O_3$ and a rubber softening oil.

7. The radar wave camouflage structure as claimed in claim 1, wherein the first layer further comprises a crosslinker comprising polyisocyanate.

8. The radar wave camouflage structure as claimed in claim 1, wherein the second layer further comprises a filler comprising zinc stearate, a matting agent and a rubber softening oil.

9. The radar wave camouflage structure as claimed in claim 1, wherein the magnetic nanoparticles have an average particle size between 1 nm to 9.9 nm.

10. The radar wave camouflage structure as claimed in claim 1, wherein the substrate comprises metal.

11. The radar wave camouflage structure as claimed in claim 10, further comprising:

the first layer of radar wave camouflage materials having a thickness between about 10 and 50 μm on the substrate, comprising:

a polyurethane (PU) resin;

magnetic nanoparticles dispersed in the first polymer matrix, wherein the magnetic nanoparticles comprise a mixture of $Fe_3O_4$, $Fe_3O_4$-4C carbide, $Fe_3O_4$—Ni composite and $Fe_2O_3$; and a rubber softening oil.

12. The radar wave camouflage structure as claimed in claim 11, further comprising:
the second layer having a thickness between about 1 and 2 mm on the first layer, comprising:
carbon black dispersed in the second polymer matrix;
a filler comprising zinc stearate;
a matting agent; and
a rubber softening oil.

13. The radar wave camouflage structure as claimed in claim 12, further comprising:
the third layer having a thickness between about 0.1 and 1 mm on the second layer, comprising:
a polyurethane (PU) resin;
carbon black dispersed in the third polymer matrix;
a filler comprising zinc stearate;
a matting agent;
an anti-oxidant;
wax; and
a rubber softening oil, wherein an absorbance of the radar wave camouflage structure is greater than 10 dB in a 8~12 GHz frequency band.

14. The radar wave camouflage structure as claimed in claim 1, wherein the substrate comprises cloth.

15. The radar wave camouflage structure as claimed in claim 14, further comprising:
the first layer of radar wave camouflage materials having a thickness between about 10 and 50 μm on the substrate, comprising:
a polyurethane (PU) resin;
magnetic nanoparticles dispersed in the polyurethane (PU) resin, wherein the magnetic nanoparticles comprise a mixture of $Fe_3O_4$, $Fe_3O_4$-4C carbide, $Fe_3O_4$—Ni composite and $Fe_2O_3$;
$Sb_2O_3$;and
a rubber softening oil.

16. The radar wave camouflage structure as claimed in claim 15, further comprising:
the second layer having a thickness between about 0.1 and 1 mm on the first layer, comprising:
a polyurethane (PU) resin;
carbon black dispersed in the second polymer matrix;
a filler comprising zinc stearate;
a matting agent; and
a rubber softening oil, wherein an absorbance of the radar wave camouflage structure is greater than 10 dB in a 8~12 GHz frequency band.

17. A method of fabricating a radar wave camouflage structure, comprising:
providing a substrate;
forming a first layer on the substrate, comprising:
a first polymer matrix; and
magnetic nanoparticles dispersed in the first polymer matrix, wherein the magnetic nanoparticles comprise a mixture of $Fe_3O_4$, $Fe_3O_4$-4C carbide, $Fe_3O_4$—Ni composite and $Fe_2O_3$; and
forming a second layer on the first layer, comprising:
a second polymer matrix; and
carbon black dispersed in the second polymer matrix.

18. The method of fabricating the radar wave camouflage structure as claimed in claim 17, further comprising forming a third layer on the second layer comprising:
a third polymer matrix; and
carbon black dispersed in the third polymer matrix.

19. The method of fabricating the radar wave camouflage structure as claimed in claim 18, wherein the third layer further comprises a filler comprising zinc stearate and a matting agent.

20. The method of fabricating the radar wave camouflage structure as claimed in claim 18, wherein the third layer further comprises wax and a rubber softening oil.

21. The method of fabricating the radar wave camouflage structure as claimed in claim 17, wherein the first, second and third polymer matrix are polyurethane (PU) resin.

22. The method of fabricating the radar wave camouflage structure as claimed in claim 17, wherein the first layer further comprises $Sb_2O_3$ and a rubber softening oil.

23. The method of fabricating the radar wave camouflage structure as claimed in claim 17, wherein the first layer further comprises a crosslinker comprising polyisocyanate.

24. The method of fabricating the radar wave camouflage structure as claimed in claim 17, wherein the second layer further comprises a filler comprising zinc stearate, a matting agent and a rubber softening oil.

25. The method of fabricating the radar wave camouflage structure as claimed in claim 17, wherein the magnetic nanoparticles have an average particle size between 1 nm to 9.9 nm.

26. The method of fabricating the radar wave camouflage structure as claimed in claim 17, wherein the substrate comprises cloth.

27. The method of fabricating the radar wave camouflage structure as claimed in claim 26, further comprising:
forming the first layer of radar wave camouflage materials having a thickness between about 10 and 50 μm on the substrate, comprising:
a polyurethane (PU) resin;
magnetic nanoparticles dispersed in the polyurethane (PU) resin, wherein the magnetic nanoparticles comprise a mixture of $Fe_3O_4$, $Fe_3O_4$-4C carbide, $Fe_3O_4$—Ni composite and $Fe_2O_3$;
$Sb_2O_3$; and
a rubber softening oil.

28. The method of fabricating the radar wave camouflage structure as claimed in claim 27, further comprising:
forming the second layer having a thickness between about 0.1 and 1 mm on the first layer, comprising:
a polyurethane (PU) resin;
carbon black dispersed in the second polymer matrix;
a filler comprising zinc stearate;
a matting agent; and
a rubber softening oil, wherein an absorbance of the radar wave camouflage structure is greater than 10 dB in a 8~12 GHz frequency band.

29. The method of fabricating the radar wave camouflage structure as claimed in claim 17, wherein the substrate comprises metal.

30. The method of fabricating the radar wave camouflage structure as claimed in claim 28, further comprising:
forming the first layer of radar wave camouflage materials having a thickness between about 10 and 50 μm on the substrate, comprising:
a polyurethane (PU) resin;
magnetic nanoparticles dispersed in the first polymer matrix, wherein the magnetic nanoparticles comprise a mixture of $Fe_3O_4$, $Fe_3O_4$-4C carbide, $Fe_3O_4$—Ni composite and $Fe_2O_3$; and
a rubber softening oil.

31. The method of fabricating the radar wave camouflage structure as claimed in claim 30, further comprising:
forming the second layer having a thickness between about 1 and 2 mm on the first layer, comprising:
carbon black dispersed in the second polymer matrix;
a filler comprising zinc stearate;
a matting agent; and
a rubber softening oil.

32. The method of fabricating the radar wave camouflage structure as claimed in claim 31, further comprising:

forming the third layer having a thickness between about 0.1 and 1 mm on the second layer, comprising:

a polyurethane (PU) resin;

carbon black dispersed in the third polymer matrix;

a filler comprising zinc stearate;

a matting agent;

an anti-oxidant;

wax; and a rubber softening oil, wherein an absorbance of the radar wave camouflage structure is greater than 10 dB in a 8~12 GHz frequency band.

* * * * *